US006618567B2

(12) United States Patent
Glasenapp et al.

(10) Patent No.: US 6,618,567 B2
(45) Date of Patent: Sep. 9, 2003

(54) PHOTOCONDUCTOR DRUM HAVING CORE ELEMENT WITH ROUGHENED SURFACE

(75) Inventors: Mario Glasenapp, Anröchte (DE); Manfred Görlich, Arnsberg (DE); Reinhold Waldeyer, Warburg (DE)

(73) Assignee: AEG Elektrofotografie GmbH, Warstein (DE)

( * ) Notice: Subject to any disclaimer, the term of this patent is extended or adjusted under 35 U.S.C. 154(b) by 0 days.

(21) Appl. No.: 09/938,582

(22) Filed: Aug. 27, 2001

(65) Prior Publication Data

US 2002/0131793 A1 Sep. 19, 2002

(30) Foreign Application Priority Data

Mar. 16, 2001 (DE) ..... 201 04 549

(51) Int. Cl.[7] ..... G03G 15/00
(52) U.S. Cl. ..... 399/159; 399/117
(58) Field of Search ..... 399/159, 164, 399/116, 117

(56) References Cited

U.S. PATENT DOCUMENTS 3,808,575 A * 4/1974 Brandt et al.
4,330,914 A * 5/1982 Hood
5,599,265 A * 2/1997 Foltz ..... 399/159
5,752,136 A * 5/1998 Sanchez et al. ..... 399/117
6,075,955 A * 6/2000 Cais et al. ..... 399/159
6,097,914 A * 8/2000 Tanaka et al. ..... 399/159
6,131,003 A * 10/2000 Cais et al. ..... 399/159
6,131,006 A * 10/2000 Oogami ..... 399/159
6,406,656 B1 * 6/2002 Thompson et al. ..... 399/159

FOREIGN PATENT DOCUMENTS

| | | | |
|---|---|---|---|
| EP | 0 526 208 A1 | | 7/1992 |
| JP | 5-305681 | * | 11/1993 |
| JP | 6-230707 | * | 8/1994 |
| JP | 9-160412 | * | 6/1997 |
| JP | 10-196637 | * | 7/1998 |
| JP | 2000-89611 | * | 3/2000 |

* cited by examiner

*Primary Examiner*—Susan S. Y. Lee
(74) *Attorney, Agent, or Firm*—Hoffman, Wasson & Gitler P.C.

(57) ABSTRACT

Photoconductor drum having a hollow cylindrical base element with a coating on the outer surface including at least one photosensitive layer, the base element concentrically accommodating at least one core element which is made at least partially cylindrical and which is made at least partially of plastic, the core element on its outer surface which comes into contact with the inside of the base element having irregularities or roughness.

11 Claims, 3 Drawing Sheets

PHOTOCONDUCTOR DRUM HAVING CORE ELEMENT WITH ROUGHENED SURFACE

BACKGROUND OF THE INVENTION

This invention relates to a photoconductor drum having a hollow cylindrical base element with a coating on the outer surface including at least one photosensitive layer, the base element concentrically accommodating at least one core element which is made at least partially cylindrical and which is made at least partially of plastic.

A photoconductor drum of the initially mentioned type is described for example in EP 0 526 208 A1. Photoconductor drums of this type are used for example in copiers or printers. The photosensitive layer on the outer surface of the photoconductor drum is electrically charged or discharged by being brought into contact with an electrically conductive roller which rolls on the circumference of the photoconductor drum. This roller which is used for charging and discharging transmits a dc voltage with a relatively high frequency to the photoconductor drum. By this continuous charging and discharging process the photoconductor drum and the charging roller are alternately attracted and repelled. The resulting vibrations produce noise which is undesirable. EP 0 526 208 A1 proposes various measures for noise suppression, these suppression measures being mainly electronic. It is also mentioned in the embodiments that the photoconductor drum can consist of a hollow, cylindrical base element which accommodates a core element which is made roughly cylindrical and which consists at least partially of plastic.

The object of this invention is to devise a photoconductor drum with improved properties with respect to damping of noise development in the charging and discharging process which far surpasses the existing art.

SUMMARY OF THE INVENTION

Achieving this object there is disclosed a photoconductor drum of made of a hollow cylindrical base element with a coating on the outer surface thereof. There is a core element made partially of plastic which has on its outer surface which comes into contact with the inside of the base element various irregularities or roughness. It was ascertained that this design leads to better noise damping, since the vibrations are damped during the mutual alternating attraction and repulsion between the photoconductor drum and the charging roller. The vibration behavior of the photoconductor drum is especially improved by the core element which is made at least partially of plastic. It is no longer in contact, over its entire surface, with the generally metal base element in the initial state, but only in the area of the irregularities which project to the outside on the outer surface of the core element.

According to one development of the invention, the vibration behavior is further improved when the core element is made entirely of plastic. This enables simplified production of the core element, which can be, for example, an injection molded part.

These irregularities of the outer surface of the core element can be formed, for example, by nubs or knurling of the surface. This knurling can take place by mechanical working of the surface of the core element which can follow the production process, for example, by injection molding. The core element can equally well be injected beforehand in a corresponding mold with irregularities on the outer surface, for example, with nubs. These nubs can be for example roughly annular. Within these annular nubs there can be cylindrical and/or conical crater-like depressions, so that elevations relative to the actual outer surface of the core element and moreover, depressions are formed. One sample version of the invention calls for nub-like elevations to be located in the same areas as the crater-like depressions, for example, the nub-like annular elevations surrounding the crater-like depressions.

The core element need not be solid, but can be hollow inside. For example, the core element, within the framework of the invention, can have a cylindrical, or conical, inner cavity so that it is made in principle, annular, the material being saved and vibration-damping properties being good.

The core elemen, which due to the vibration-damping properties, can also be called an equalizer, and can be made for example of plastics, such as polypropylene, polyethylene, polyamide, or the like. Mixtures of these materials, or other plastics, are also possible. The core element can be made of a uniform material, or of several components. After production, for example, roughness of the surface can be achieved by roughening with a knurling tool. Then, preferably, the core element (equalizer) is pressed into the generally cylindrical metal base element of the photoconductor drum. This pressing can take place such that the equalizer locks and no additional mounting means are necessary. The base element of the photoconductor drum can be made, for example, of an aluminum tube with an outer photosensitive coating. The weight of the plastic core element can be, for example, in the range between roughly 40 and roughly 150 g and is preferably in the range between roughly 50 and 70 g. For a weight in these ranges especially good vibration-damping properties can be established.

The core element can have a rough annular molded attachment (cone gate) on at least one end side. Cone gates provided on the equalizer are advantageous on both sides in order to achieve better filling behavior in the tool during injection molding. They have no function for the actual damping in the image carrier.

BRIEF DESCRIPTION OF THE FIGURES

This invention is detailed below using embodiments with reference to the attached drawings:

FIG. 2 shows a section of the photoconductor drum with the core element pressed in;

DETAILED DESCRIPTION OF THE INVENTION

Figure 1:
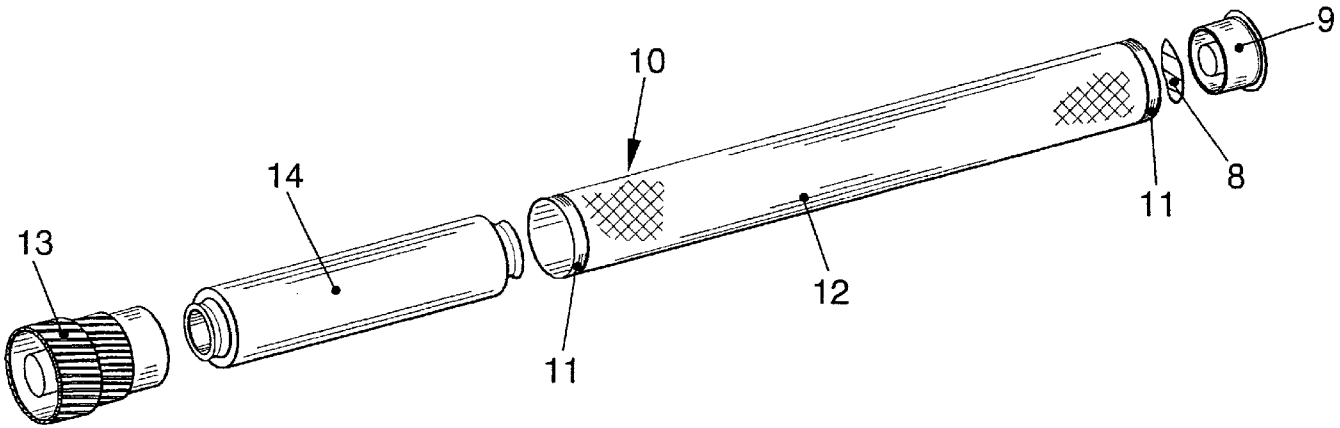
FIG. 1 shows an exploded view of a photoconductor drum as claimed in this invention.

A photoconductor drum 10 in an exploded view is depicted in FIG. 1. In principle, this photoconductor drum has a base element 11 which can be roughly a cylindrical aluminum tube with an external coating 12 of a photosensitive layer. The ends of this base element are generally free of the photosensitive layer.

FIG. 1 furthermore shows the core element 14 and a gear 13 which is, for example, helical and which is part of the drive for the photoconductor drum. This gear 13 is attached on one end side of the photoconductor drum. On the other end, there is a flange 9 with a contact spring 8.

Figure 2:
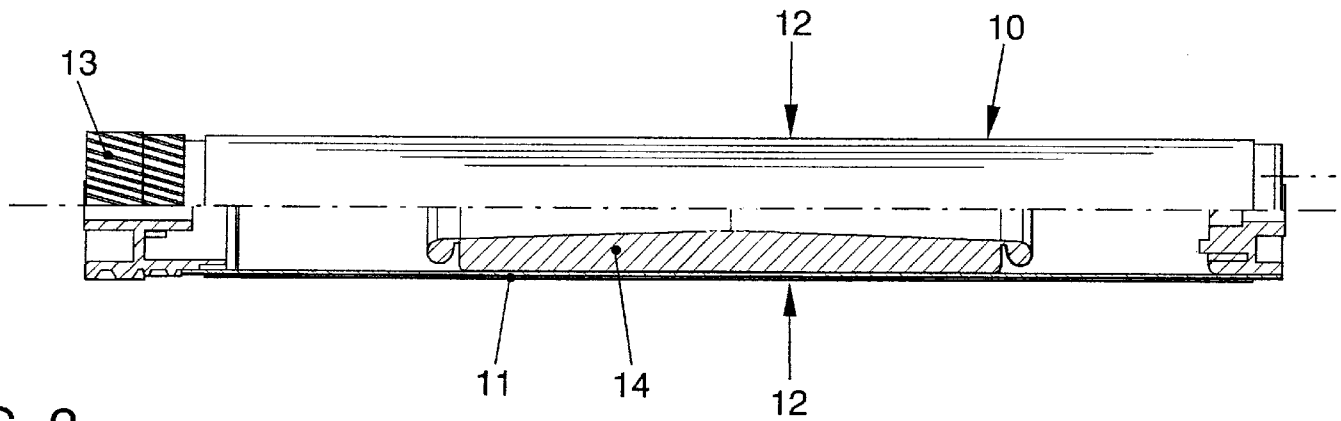

It is apparent from the sectional view, shown in FIG. 2, that the core element 14 is accommodated concentrically by the cylindrical base element 11 and in doing so is pressed into it.

Figure 3:
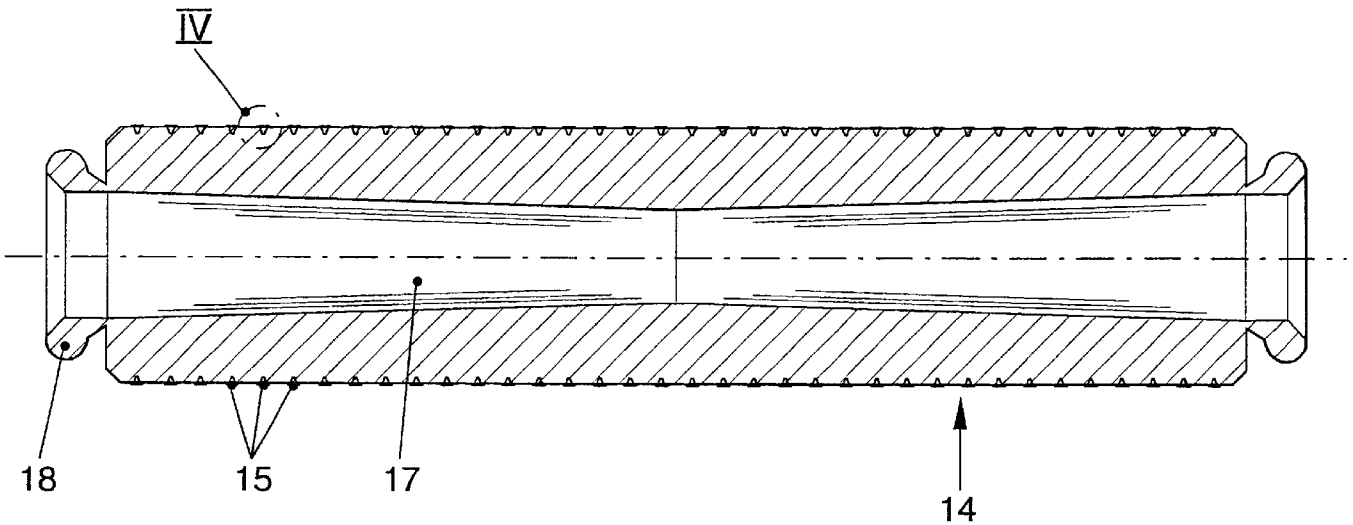
FIG. 3 shows an enlarged section of only the core element.
Figure 4:
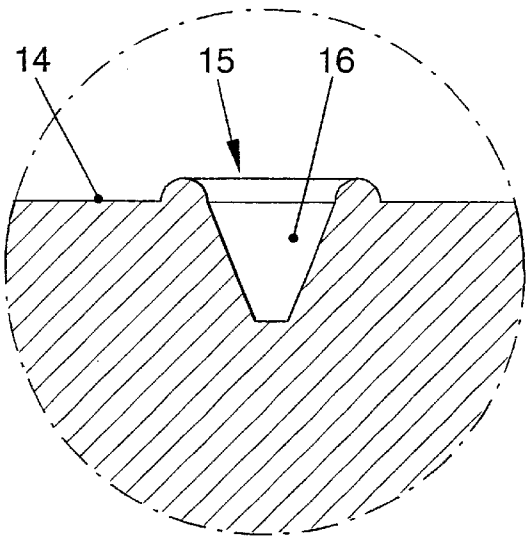
FIG. 4 shows an enlarged detail extract from FIG. 3.

Other details relating to the core element are shown in FIGS. 3 and 4 and are described below. The core element 14 is shown cutaway in FIG. 3. The cone gate 18, which is injected on one end as a rough annular molded attachment, is shown. Furthermore, FIG. 3 shows that the core element 14 is hollow inside and has a concentric inner cavity 17 which has its smallest cross section in the middle of the core element and expands slightly conically from there towards the two ends. Furthermore, FIG. 3 shows that the outer surface of the core element 14 has irregularities in the form of nubs 15 with a shape which is shown in detail better in FIG. 4.

Figure 5:
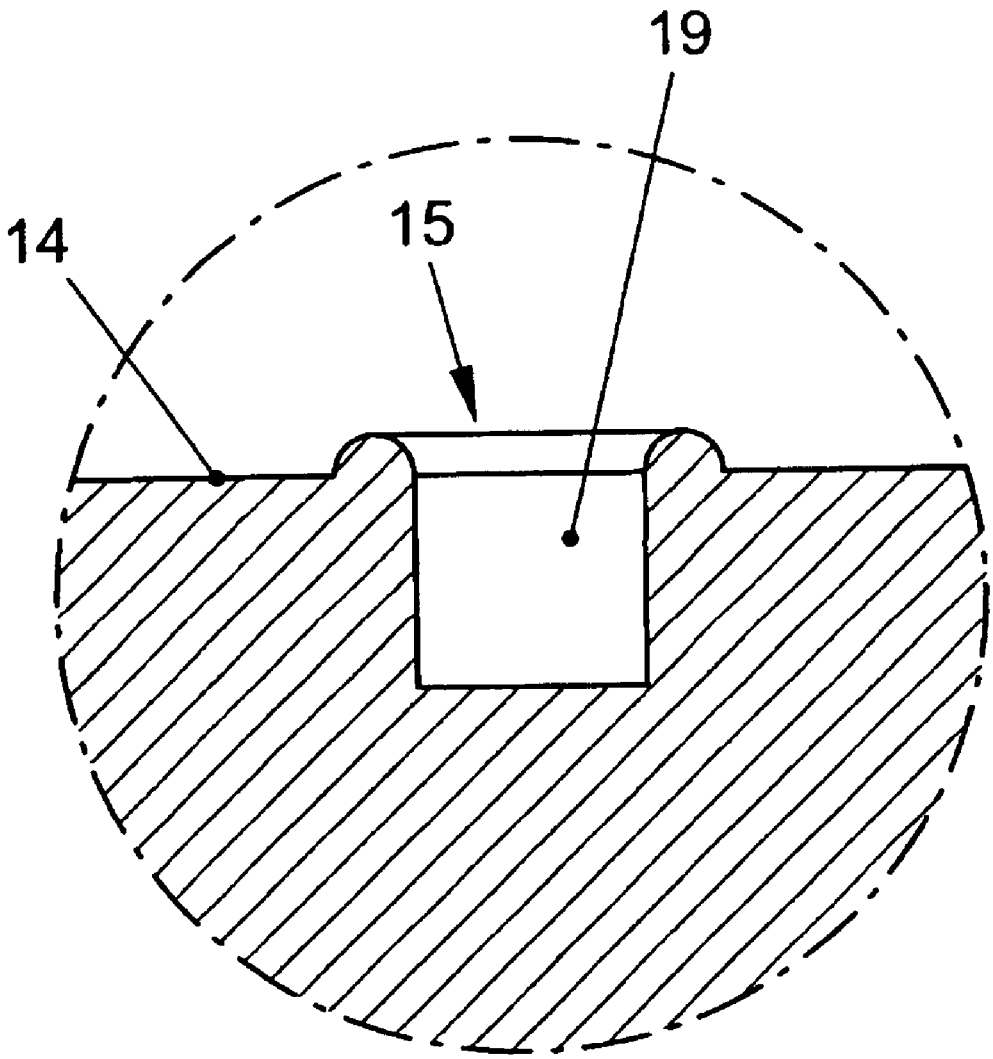
FIG. 5 shows an enlarged detail of the core element having a cylindrical depression.

FIG. 4 shows a highly enlarged cut-out from the surface of the core element 14 shown in a lengthwise section. The section shows one of the nubs 15 which in principle is an annular elevation relative to the outer surface of the core element 14, in the center of the annular nub 15 there being a conical depression 16. FIG. 5 shows an alternative embodiment having cylindrical depressions 19. Of course, numerous alternative versions for forming these nubs, or other irregularities, or roughness, on the outer surface of the core element 14 are conceivable, by means of which a similar effect can be achieved. As is apparent from FIG. 3, generally a plurality of such nubs 15, or irregularities, are distributed on the outer surface of the core element, preferably at roughly regular intervals both over the length and also over the periphery of the outer surface of the core element 14.

The invention is described by various embodiments and is only limited in scope by the claims. Reasonably skilled artisans would able to make modifications and changes and still be determined to fall within the scope of the present invention.

What is claimed is:

1. A photoconductor drum comprising a hollow cylindrical base element having a coating on an outer surface, said coating comprising at least one photosensitive layer, the base element concentrically accommodating at least one core element, the core element having an outer surface having irregularities contacting an inside of the base element, wherein the irregularities are formed by knurling to form rough annular nubs.

2. The photoconductor drum as claimed in claim 1, wherein the core element is plastic.

3. The photoconductor drum as claimed in claim 1, wherein the core element outer surface has cylindrical or conical depressions.

4. The photoconductor drum as claimed in 1, wherein the rough annular nubs surround cylindrical or conical depressions.

5. The photoconductor drum as claimed in claim 1, wherein the core element is hollow.

6. The photoconductor drum as claimed in claim 1, wherein the core element has a cylindrical or conical inner cavity.

7. The photoconductor drum as claimed in claim 1, wherein the core element comprises polypropylene, polyethylene, polyamide.

8. The photoconductor drum as claimed in claim 1, wherein the core element is made by injection molding.

9. A photoconductor drum comprising a hollow cylindrical base element having a coating on an outer surface, said coating comprising at least one photosensitive layer, the base element concentrically accommodating at least one core element, the core element having an outer surface having irregularities contacting an inside of the base element formed by knurling wherein the core element has a rough annular molded attachment on at least one end side.

10. A photoconductor drum comprising a hollow cylindrical base element having a coating on an outer surface, said coating comprising at least one photosensitive layer, the base element concentrically accommodating at least one core element, the core element having an outer surface having irregularities contacting an inside of the base element, wherein the irregularities are formed by knurling and the core element has a weight in the range from 40 and 150 g.

11. The photoconductor drum as claimed in claim 10, wherein the core element has a weight in the range from between 50 and 70 g.

* * * * *